US009885552B2

(12) United States Patent
Krause

(10) Patent No.: US 9,885,552 B2
(45) Date of Patent: Feb. 6, 2018

(54) BONDED DEFORMATION BULLET

(71) Applicant: RUAG Ammotec GmbH, Fürth (DE)

(72) Inventor: Bernd Krause, Nürnberg (DE)

(73) Assignee: RUAG AMMOTEC GMBH, Fürth (DE)

( * ) Notice: Subject to any disclaimer, the term of this patent is extended or adjusted under 35 U.S.C. 154(b) by 0 days.

(21) Appl. No.: 15/121,252

(22) PCT Filed: Feb. 24, 2015

(86) PCT No.: PCT/EP2015/053853

§ 371 (c)(1),
(2) Date: Aug. 24, 2016

(87) PCT Pub. No.: WO2015/128331

PCT Pub. Date: Sep. 3, 2015

(65) Prior Publication Data

US 2016/0363424 A1 Dec. 15, 2016

(30) Foreign Application Priority Data

Feb. 25, 2014 (DE) ..... 10 2014 002 441

(51) Int. Cl.
*F42B 12/34* (2006.01)
*F42B 12/74* (2006.01)
(Continued)

(52) U.S. Cl.
CPC ..... *F42B 12/34* (2013.01); *F42B 12/74* (2013.01); *F42B 12/78* (2013.01); *F42B 30/02* (2013.01); *F42B 33/00* (2013.01)

(58) Field of Classification Search
CPC ..... F42B 12/34; F42B 12/74; F42B 12/78; F42B 33/00; F42B 30/02
(Continued)

(56) References Cited

U.S. PATENT DOCUMENTS 2,045,964 A * 6/1936 Rinkel ..... F42B 12/34 102/509
5,357,866 A 10/1994 Schluckebier et al.
(Continued)

FOREIGN PATENT DOCUMENTS

GB 04426 0/1899

OTHER PUBLICATIONS

International Search Report for PCT/EP2015/053853 dated May 4, 2015; English translation submitted herewith (7 Pages).

*Primary Examiner* — James S Bergin
(74) *Attorney, Agent, or Firm* — Fitch, Even, Tabin & Flannery, LLP

(57) ABSTRACT

The invention relates to a method for producing a deformation bullet, consisting of a projectile core made from lead in a tombac jacket. So that the performance of the bullet, such as the accuracy, deformation and energy transfer in the target medium can be adjusted and a homogeneous core of the bullet is created, the structure of which has a predefined breaking point on the center axis of the bullet, the following method steps are suggested: a. manufacture of a cup-shaped tombac jacket, introduction of lead into the tombac jacket and soldering of the lead with the tombac jacket in order to produce a blank, b. introduction of a pre-existing defect into the lead of the blank by pressing a die displaceable on the center axis of the blank into the lead and then removing the die, c. final pressing of the blank into the final shape of the deformation bullet with outer longitudinal grooves on the ogive and with a rear inner cone 6, wherein a pressing force larger than 7000 N is used during the final pressing process.

7 Claims, 3 Drawing Sheets

(51) Int. Cl.
*F42B 12/78* (2006.01)
*F42B 30/02* (2006.01)
*F42B 33/00* (2006.01)

(58) Field of Classification Search
USPC ..... 102/501, 509; 86/54, 55
See application file for complete search history.

(56) References Cited

U.S. PATENT DOCUMENTS

| | | | | |
|---|---|---|---|---|
| 5,641,937 | A | 6/1997 | Carter | |
| 6,148,731 | A * | 11/2000 | Winter ..... | F42B 12/34 102/501 |
| 6,581,503 | B1 | 6/2003 | Olin | |
| 2002/0152915 | A1 | 10/2002 | Vaughn et al. | |

* cited by examiner

Fig. 1
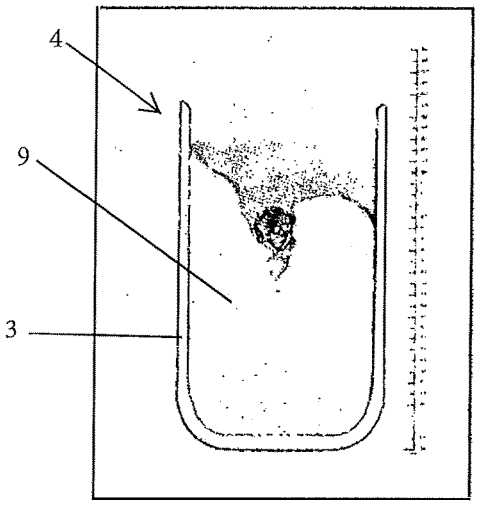
Bonded Blank
Fig. 2
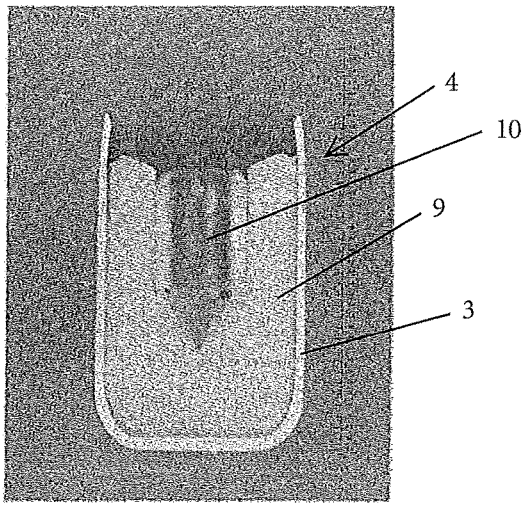
Pressed "Pre-existing Defect"
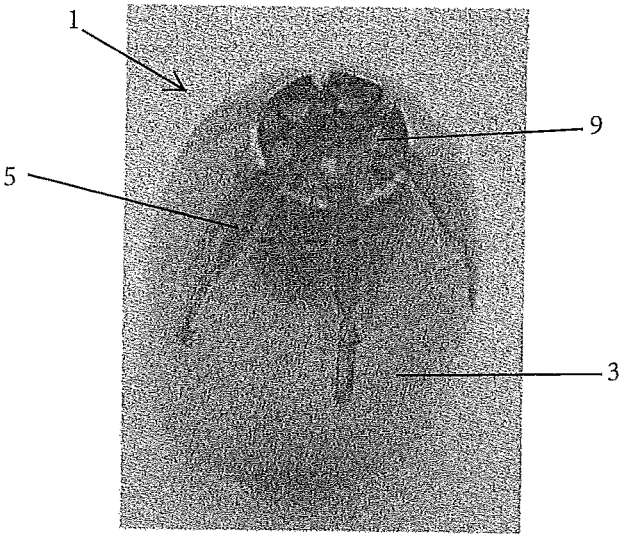
Finished Bullet
Fig. 3

Fig. 4
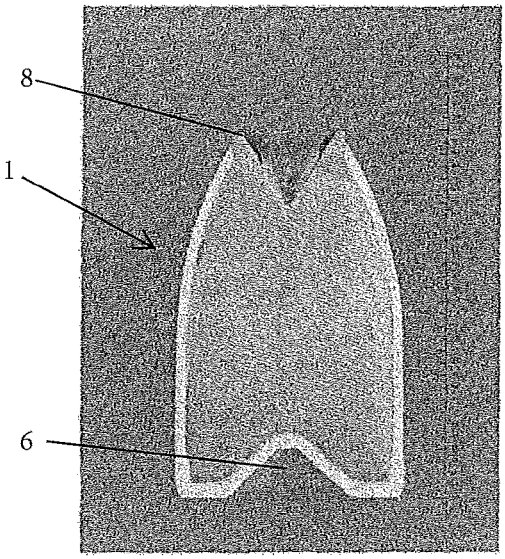
High Pressing Force
Fig. 5
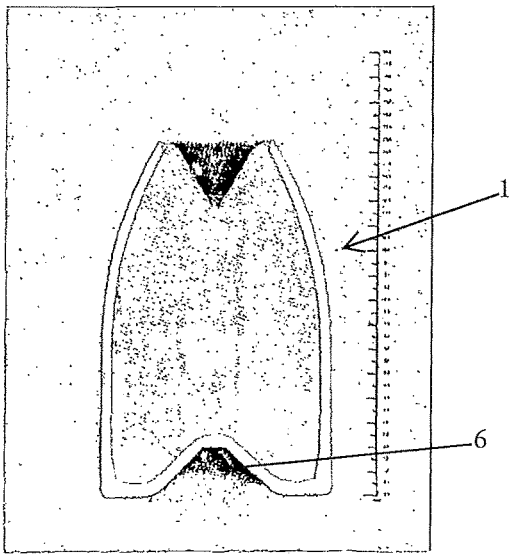
Lower Pressing Force
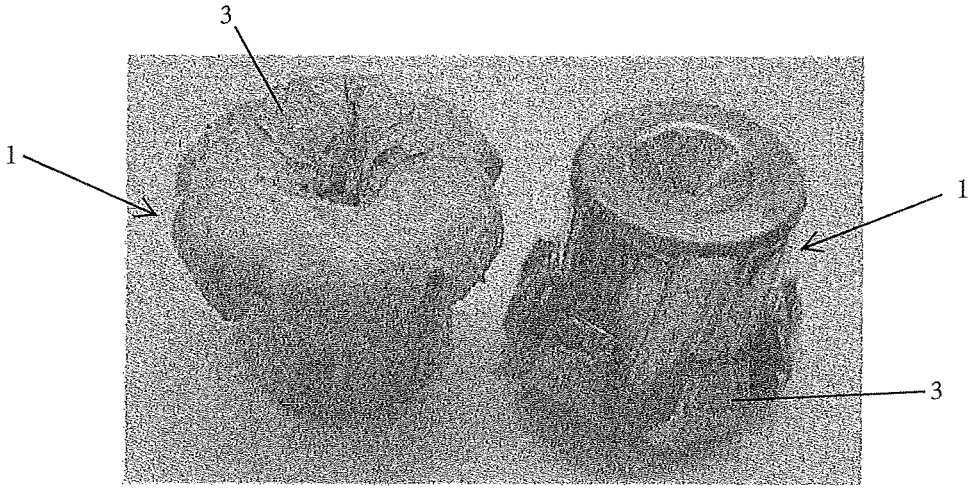
After Firing at Soft Target
Fig. 6

Fig. 7
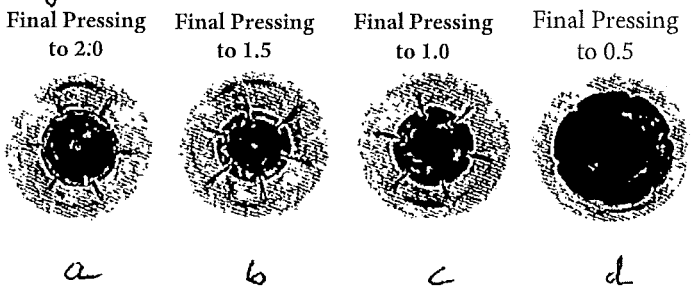
Fig. 8
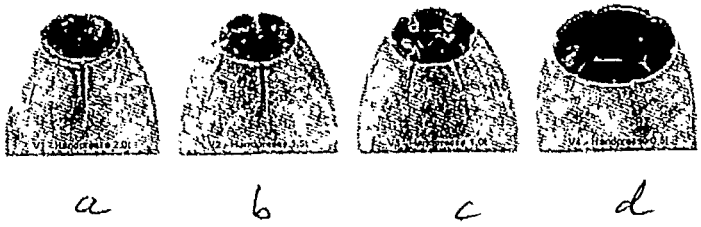
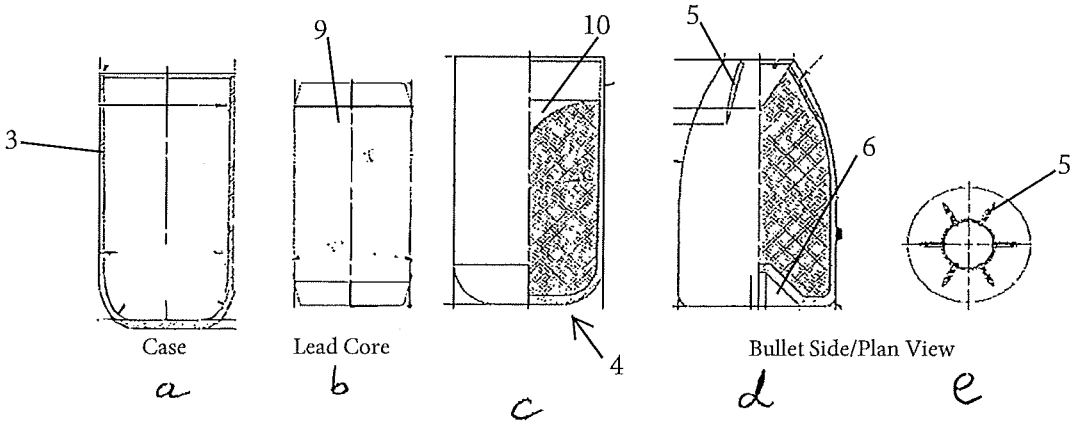
Fig. 9

BONDED DEFORMATION BULLET

BACKGROUND OF THE INVENTION

The invention relates to a method for producing a deformation bullet, consisting of a bullet core made from lead in a tombac jacket.

BRIEF SUMMARY OF THE INVENTION

The object of the invention is to provide a method for producing a deformation bullet, by which the performance of the bullet, such as accuracy, deformation and energy transfer in the target medium, can be adjusted. Moreover, a homogeneous core of the bullet should be created, the structure of which has a "predefined breaking point."

This object is achieved by a method comprising the following method step:

a) manufacture of a cup-shaped tombac jacket, introduction of lead into the tombac jacket and soldering of the lead with the tombac jacket in order to produce a blank, b) introduction of a pre-existing defect into the lead of the blank by pressing a die displaceable on the center axis of the blank into the lead and then removing the die, and c) final pressing of the blank into the final shape of the deformation bullet with outer longitudinal grooves on the ogive and with a rear inner cone, wherein a pressing force larger than 7,000 N is used during the final pressing process.

BRIEF DESCRIPTION OF THE SEVERAL VIEWS OF THE DRAWINGS

FIG. 1 shows a bonded blank produced by a first manufacturing step consisting of the tombac jacket in a lead core or lead which is arranged in the tombac jacket and is soldered to the tombac jacket.

FIG. 2 shows the bonded blank according to FIG. 1 with an introduced pre-existing defect.

FIG. 3 shows the final shape of the bullet with outer longitudinal grooves and with a rear inner curve pressed.

FIG. 4 shows a finished deformation bullet in section, in which a high pressing force is used.

FIG. 5 shows a finished deformation bullet in section, in which a lower pressing force is used.

FIG. 6 shows a bonded deformation bullet according to the invention after firing at a soft target.

FIGS. 7*a*-7*d* show four deformation bullets according to the invention after the final pressing, seen in plan view from above onto the ogive and differing from one another only by the force applied during final pressing.

FIGS. 8*a*-8*d* show the same four deformation bullets according to the invention after the final pressing as in FIG. 7, only as seen laterally from above.

FIG. 9*a* shows the bullet case in section; FIG. 9*b* shows the lead core in section;

FIG. 9*c* shows the bonded blank after the first pressing in which the pre-existing defect was introduced; FIG. 9*d* shows the finally pressed bullet in section; and FIG. 9*e* shows a plan view of the ogive.

DETAILED DESCRIPTION OF THE INVENTION

The first method step (a) comprises the manufacture of a cup-shaped tombac jacket, introduction of lead into the tombac jacket and soldering of the lead with the tombac jacket in order to produce a blank. In this first method step (a), the bonded blank, consisting of a bullet core made from lead in a tombac jacket, is produced. A fixed connection is produced between the lead core or the bullet core and the tombac jacket. Bonding is always understood to mean soldering.

The second method step (b) comprises the introduction of a pre-existing defect into the lead of the blank by pressing a die displaceable on the center axis of the blank into the lead and then removing the die. By means of this pre-existing defect (parameters: depth, diameter, shape of the die), the deformation capacity of the bullet is specified. Furthermore, air inclusions, which are produced during bonding, are reduced.

The third method step (c), which can also be sub-divided into sub-steps, comprises final pressing of the blank into the final shape of the deformation bullet with outer longitudinal grooves on the ogive and with a rear inner cone, wherein a pressing force greater than 7,000 N is used during the final pressing. The flow of the lead is influenced by the pressing force exerted. The higher the force, the further the lead projects beyond the edge of the jacket. The weapon function and deformation behavior are influenced by this "lead edge." The pressing step performed in the second method step (b) generates the pre-existing defect, as a hollow space is created in the lead core or in the bullet core. During the final pressing according to the third method step (c) this hollow space is closed again. This two-stage process produces a homogeneous bullet core, the structure of which has a predefined breaking point in the center axis of the bullet. The homogeneity is already reached at a pressing force of 7,000 N. Depending upon the pressing force (typically between 10,000 N and 30,000 N), the lead is pressed into the bullet tip to a varying extent.

In one embodiment of the invention the lead used is pure lead and a jacket of CuZn3-CuZn15 is used as the tombac jacket.

A cylindrical die with a front tip is preferably used as the die.

In an embodiment according to the invention the precision and action of the bullet are adjusted by the following parameters:

a. depth, number and length of the outer longitudinal grooves on the ogive;

b. depth, diameter and shape of the pre-existing defect;

c. pressing force during pressing of the final shape of the deformation bullet.

A rear inner cone is formed into the bullet. The selected shape of the rear of the bullet with the rear inner cone serves to optimize the pressure on the core and improves the precision of the bullet.

A deformation bullet according to the invention with a bullet core made of lead in a tombac jacket, with outer longitudinal grooves on the ogive and with a rear inner cone, produced by the method described above is characterized by a homogeneous bullet core, the structure of which has a predefined breaking point in the center axis of the bullet.

The invention is described further below with reference to the drawings.

The invention describes a bonded (soldered) deformation bullet 1, preferably 9 mm caliber, consisting of the combination of pure lead soldered in a tombac jacket (CuZn3-CuZn15). The method for manufacturing the bullet is carried out in at least three stages. The performance of the bullet, such as accuracy, deformation and energy transfer in the target medium, is adjusted by the combination of these manufacturing steps and the parameters thereof.

The first manufacturing step is the production of the bonded blank 4. A fixed connection between the lead core 9 and the tombac jacket 3 is produced by this manufacturing step. FIG. 1 shows a bonded blank 4, consisting of the tombac jacket 3 and a lead core or lead 9 arranged in the tombac jacket 3 and soldered to the tombac jacket 3.

In the second state, a "pre-existing defect" 10 is pressed into the lead core or the lead 9. FIG. 2 shows the bonded blank according to FIG. 1 with the introduced pre-existing defect 10. In the embodiment illustrated here a cylindrical die with a front tip has been pressed into the lead 9 and after the pressing has been withdrawn again from the die.

By means of this pre-existing defect 10 (parameters: depth, diameter, shape of the die) the deformation capacity of the bullet 1 is specified. Furthermore, air inclusions that are produced during bonding are reduced. Bonding is always understood to mean soldering.

In the third method step—see FIG. 3—the final shape of the bullet 1 with the outer longitudinal grooves 5 and with a rear inner curve 6 is pressed. This manufacturing step can also be broken down into sub-steps.

The flow of the lead is influenced by the pressing force exerted. The higher the force, the further the lead projects beyond the edge of the jacket. The weapon function and deformation behavior are influenced by this "lead edge."

FIG. 4 shows a finished deformation bullet 1 in section, in which a high pressing force is used. The lead edge 8 can be clearly seen. A rear inner cone 6 is pressed into the bullet 1.

FIG. 5 shows a finished deformation bullet 1 in section, in which a lower pressing force is used. There is no lead present.

The combination: a) depth, number and length of the outer longitudinal grooves 5;

b) depth, diameter and shape of the pre-existing defect;

c) pressing force during final pressing influences the precision and action of the bullet.

FIG. 6 shows a bonded deformation bullet 1 according to the invention after firing at a soft target. The tombac jacket 3 has not detached from the bullet core or lead core. However, the tombac jacket has mushroomed. No parts have been loosened from the tombac jacket 3.

Thus the invention describes a deformation bullet in which the precision and action of the bullet can be adjusted by the combination of the aforementioned three features.

The combination of different material characteristics and manufacturing steps makes it possible to produce a bullet for a defined velocity with a desired terminal ballistic action. The principle can be applied to the entire caliber range.

This possible combination system is shown by way of example on a 9 mm pistol bullet.

Bonding Process

A fixed connection between the tombac jacket 3 and the lead 9 or lead core is created by the bonding process (the soldering). The material characteristics of the tombac jacket and lead core are combined in a target-oriented manner by this connection in order to achieve an optimum target impact for the defined target velocity.

Design

In addition to the elementary material properties, by means of the variation of the jacket wall thickness it is likewise possible to influence the terminal ballistic action.

"Notches" in the ogive region also serve to control the terminal ballistic behavior.

Pre-Existing Defect and Pressing Force

The cavity inserted in the lead core (see FIG. 2) in a first pressing step, introduction of the pre-existing defect, is closed again during final pressing (see FIGS. 4 and 5) of the bullet. Due to this two-stage process, a homogeneous bullet core is produced, the structure of which has a "predefined breaking point" in the central axis of the bullet. The homogeneity is already reached at a pressing force of approximately 7,000 N. Depending upon the pressing force (typically between 10,000 N and 30,000 N), the lead is pressed into the bullet tip to a varying extent.

This also influences the target ballistics.

The deformation behavior is again influenced by means of the tucks (notches) on the bullet case in the region of the ogive.

FIGS. 7*a*-7*d* show four deformation bullets according to the invention after the final pressing, seen in plan view from above onto the ogive. These bullets differ from one another only by the force applied during final pressing.

The pressures used in the final pressing decreased in order from the bullet according to FIG. 7*a* to the bullet according to FIG. 7*b* to the bullet according to FIG. 7*c* to the bullet according to FIG. 7*d*.

FIGS. 8*a*-8*d* show the same four deformation bullets according to the invention after the final pressing as in FIGS. 7*a*-7*d*, only as seen laterally from above. In all drawings, the different tips of the ogives are easy to recognize.

FIG. 9*a* shows the bullet case and FIG. 9*b* shows the lead core, in each case in section. The bullet case or tombac jacket 3 and bullet core 2 are fixedly connected to one another by the bonding process. FIG. 9*c* shows the bonded blank 4 after the first pressing in which the pre-existing defect 10 was introduced.

Then by final pressing, preferably in only one pressing operation, both the ogive with the longitudinal grooves 5, or tucks (notches) and also the rear inner cone 6 are pressed. FIG. 9*d* shows the finally pressed bullet in section and FIG. 9*e* shows a plan view of the ogive.

Tail of the Bullet

The selected shape of the tail of the bullet with the rear inner cone 6 serves to optimize the pressing of the core and improves the precision of the bullet.

Influencing factors and features of the bullet according to the invention are as follows:

case wall thickness (0.2-0.5 mm depending upon caliber up to 3 mm)

case material (copper or copper alloy)

lead core (pure lead)

bonding process (heating temperature, heating time, cooling duration, fluxing agent)

pre-existing defect in the lead (depth, cross-section, shape)

notches in the ogive (number 4-8, depth 0.4-1 mm, length 1-8 mm)

hollow tip (cross-section 2-5 mm, depth 2-8 mm)

The invention claimed is:

1. A method for producing a deformation bullet comprising a bullet core made from lead in a tombac jacket, the method comprising the following steps:

a) manufacturing a cup-shaped tombac jacket, introducing lead into the tombac jacket and soldering the lead with the tombac jacket in order to produce a blank, then b) introducing a pre-existing defect into the lead of the blank by pressing a die displaceable on the center axis of the blank into the lead and then removing the die, and then c) final pressing the blank into the final shape of the deformation bullet and providing the deformation bullet with outer longitudinal grooves on its ogive and with a rear inner cone, wherein a pressing force larger than 7,000 N is used during the final pressing process.

2. The method according to claim 1, wherein the lead used is pure lead and a jacket of CuZn3-CuZn15 is used as the tombac jacket.

3. The method according to claim 1, wherein a cylindrical die with a front tip is used as the die.

4. The method according to claim 1, further comprising controlling:

a) depth, number and length of the outer longitudinal grooves on the ogive;

b) depth, diameter and shape of the pre-existing defect; and c) pressing force during pressing of the final shape of the deformation bullet to adjust precision and action of the bullet.

5. The method according to claim 1, wherein in the step of final pressing, pressing the blank into the final shape of the deformation bullet and providing the deformation bullet with outer longitudinal grooves on its ogive and with a rear inner cone are done in one pressing operation.

6. The method according to claim 1, wherein in the step of final pressing, pressing the blank into the final shape of the deformation bullet and providing the deformation bullet with outer longitudinal grooves on its ogive and with a rear inner cone are done by a plurality of pressing operations.

7. A deformation bullet comprising a bullet core made of lead in a tombac jacket, with outer longitudinal grooves on its ogive and with a rear inner cone, produced by the method according to claim 1, wherein the bullet core is a homogeneous bullet core, the structure of which has a predefined breaking point along a center axis of the bullet.

* * * * *